United States Patent [19]

Meek et al.

[11] Patent Number: 4,557,629

[45] Date of Patent: Dec. 10, 1985

[54] OFFSHORE TOWER STRUCTURES

[75] Inventors: Jan Meek, Gouda; Maurice Uittenbogaard, AV Woerden, both of Netherlands; Finn C. Michelsen, Kailua, Hi.; Pieter S. Heerema, deceased, late of Wassenaar, Netherlands, by E. P. Heerema, executor

[73] Assignee: Heerema Engineering Service BV, Netherlands

[21] Appl. No.: 606,964

[22] Filed: May 4, 1984

Related U.S. Application Data

[63] Continuation of Ser. No. 354,710, Mar. 4, 1982, abandoned.

[30] Foreign Application Priority Data

Mar. 4, 1981 [GB] United Kingdom ..... 8106753

[51] Int. Cl.[4] ..... E02B 17/00; E02D 23/02; E02D 25/00

[52] U.S. Cl. ..... 405/204; 405/195; 405/205

[58] Field of Search ..... 405/195, 196, 202, 204, 405/205, 208, 203, 207, 224

[56] References Cited

U.S. PATENT DOCUMENTS

| | | | |
|---|---|---|---|
| Re. 29,413 | 9/1977 | Hekkanen et al. | 405/204 |
| 3,716,994 | 2/1973 | Pogonowski | 405/204 |
| 3,815,372 | 6/1974 | Chow | 405/208 |
| 3,852,969 | 12/1974 | Gibson et al. | 405/204 |
| 4,000,624 | 1/1977 | Chow | 405/204 |
| 4,100,754 | 7/1978 | Vogel | 405/205 |
| 4,170,431 | 10/1979 | Wood | 405/195 X |

FOREIGN PATENT DOCUMENTS

| | | | |
|---|---|---|---|
| 2270390 | 12/1975 | France | 405/204 |
| 2309749 | 11/1976 | France | 405/195 |
| 1491684 | 11/1977 | United Kingdom | 405/204 |

*Primary Examiner*—Cornelius J. Husar
*Assistant Examiner*—Nancy J. Stodola
*Attorney, Agent, or Firm*—Fulwider, Patton, Rieber, Lee & Utecht

[57] ABSTRACT

The invention provides an offshore tower structure comprising a base structure for positioning on the sea bed, a central enclosed tubular column 20 containing services such as conductors and risers and extending from the base structure to above the water level, in use, for supporting a service platform 21 and at least three tubular support legs 22, 23, 24 each extending between the base structure at a point spaced apart from the column and an upper portion of the tubular column, the support legs each being rigidly attachable to the base structure and to the column and the base structure providing means for maintaining the spacing between the support legs and the column, in which each support leg is attached to the column by welding and there is means to provide a water tight compartment around the joint from which water can be removed so that the leg can be welded to the column in dry surroundings.

6 Claims, 12 Drawing Figures

OFFSHORE TOWER STRUCTURES

This is a continuation of application Ser. No. 354,710 filed Mar. 4, 1982 now abandoned.

The invention relates to offshore tower structures and more particularly, but not exclusively, to structures which can be used in ocean depths up to 450 meters.

The invention provides an offshore tower structure comprising a base structure for positioning on the sea bed, a central enclosed tubular column containing services such as conductors and risers and extending from the base structure to above the water level, in use, for supporting a service platform and at least three tubular support legs each extending between the base structure at a point spaced apart from the column and an upper portion of the tubular column, the support legs each being rigidly attachable to the base structure and to the column and the base structure providing means for maintaining the spacing between the support legs and the column, in which each support leg is attached to the column by welding and there is means to provide a water tight compartment around the joint from which water can be removed so that the leg can be welded to the column in dry surroundings.

The support legs are preferably each rigidly attached to the base structure and to the column and the base structure and each support leg is preferably attached to the base structure by means of a recess which allows the support leg to swing between a vertical position and a position inclined to the vertical and in which locking means are provided between the leg and the base structure which engage automatically when the leg is swung from the vertical to the inclined position.

A specific embodiment of a fixed offshore tower structure according to the invention will now be described with reference to the accompanying drawings in which.

Figure 5A:
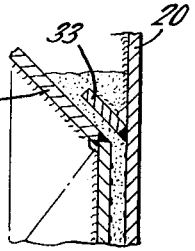
FIG. 5 is a sectional view on the line 5—5 in FIG. 4.
Figure 5:
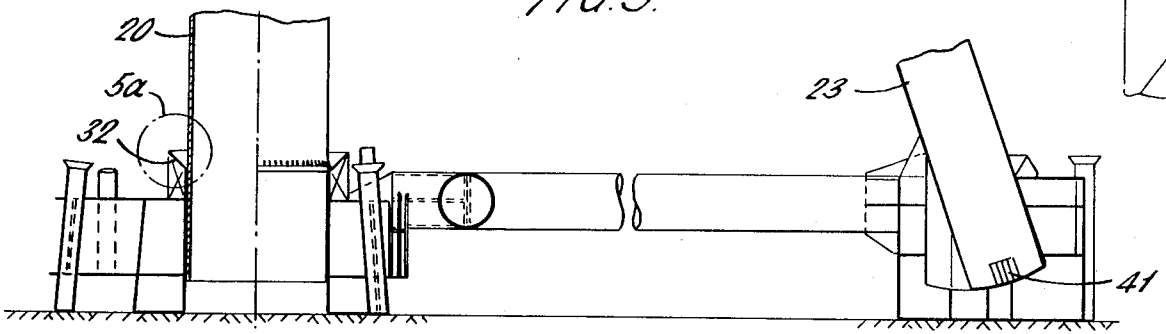
Figure 6:
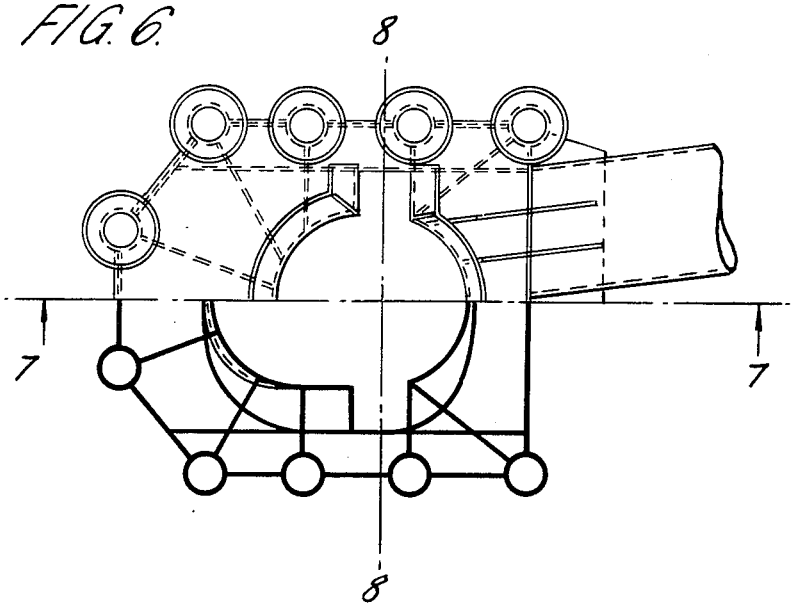
Figure 7:
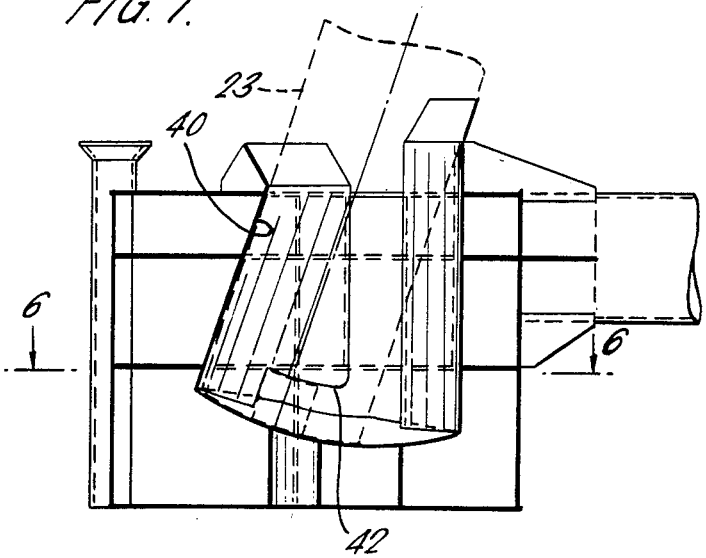
Figure 8:
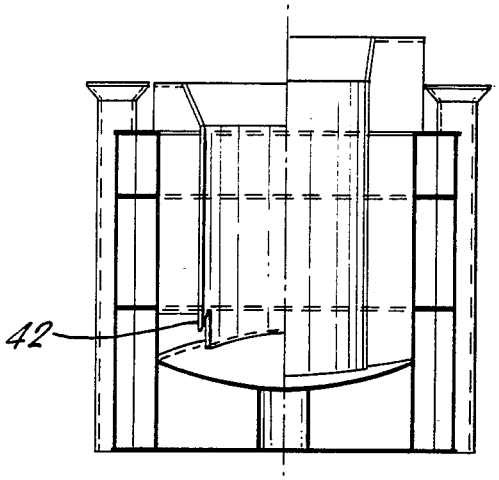
Figure 9:
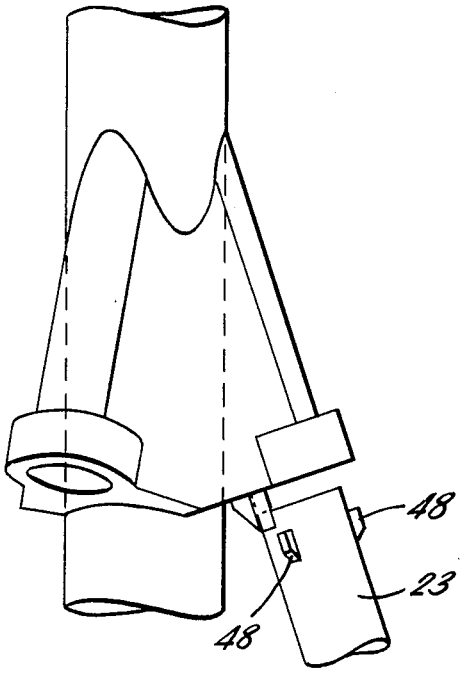
Figure 10:
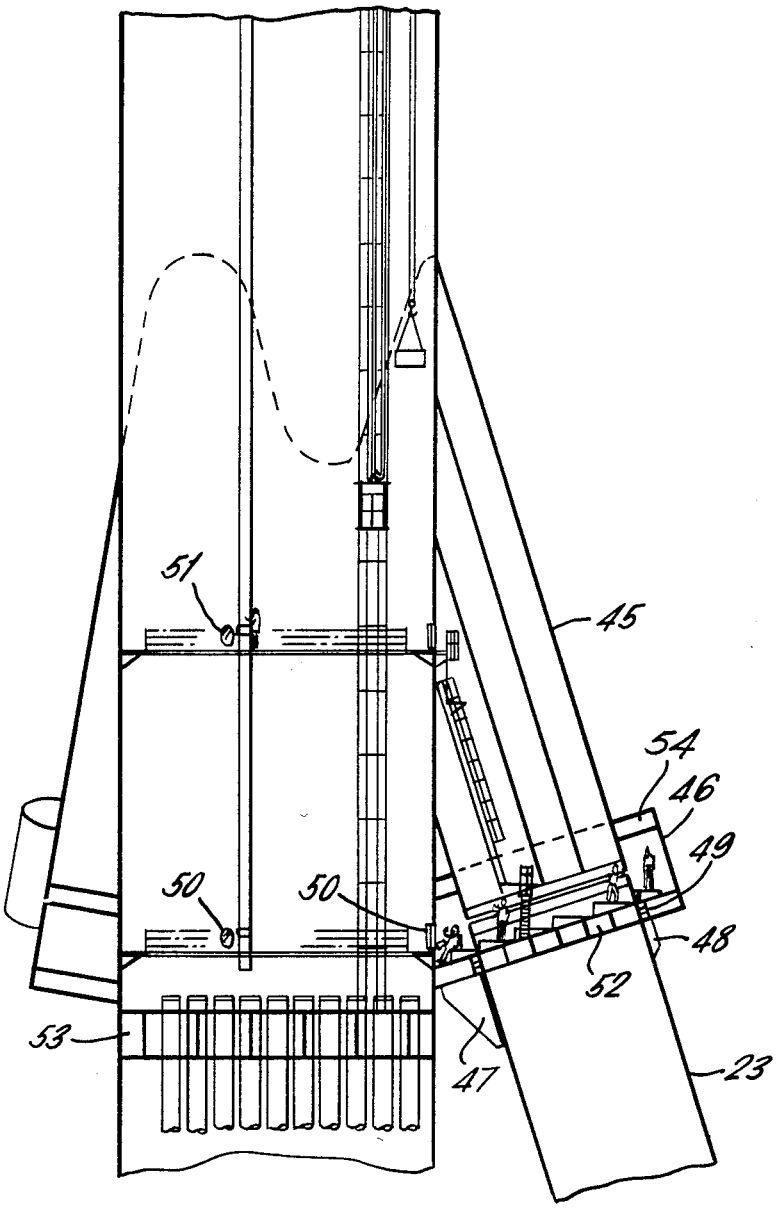
Figure 11:
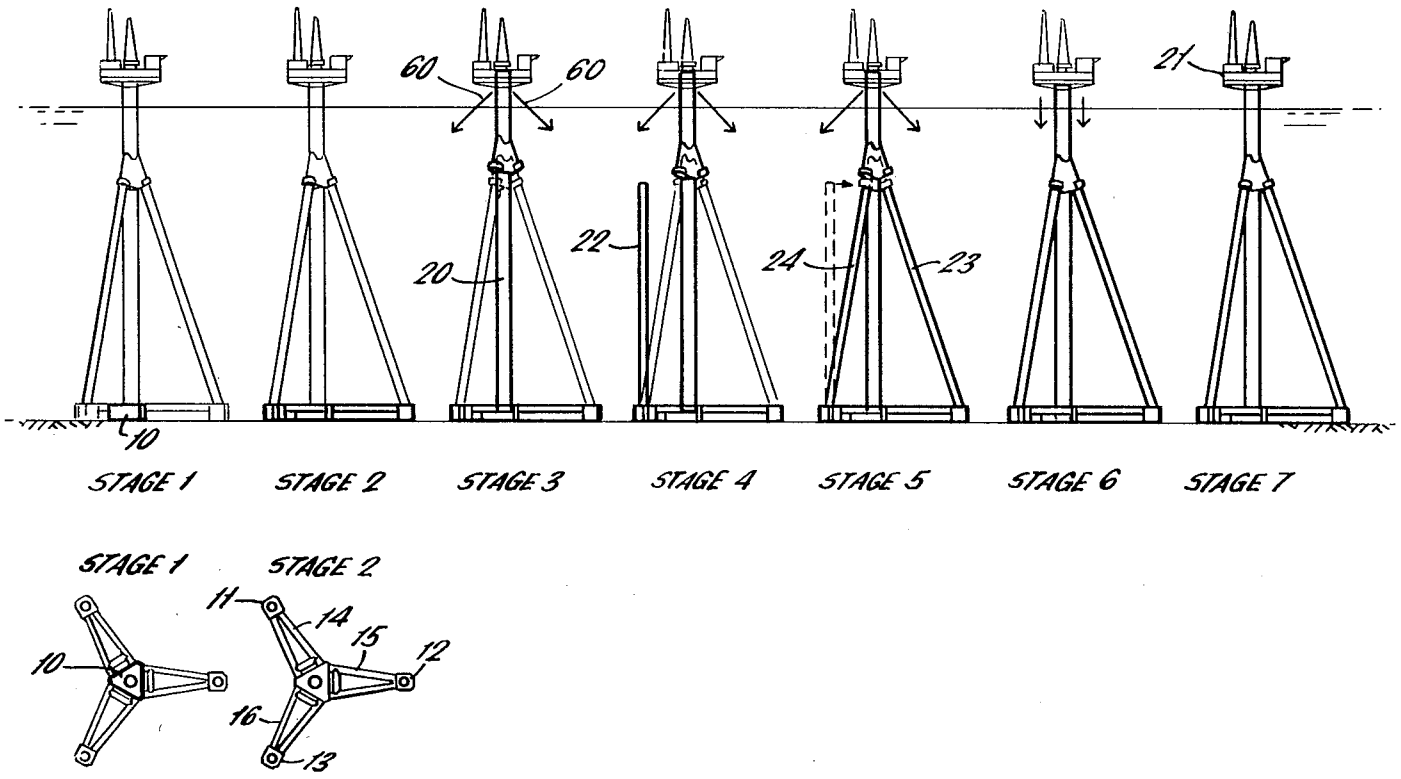

FIG. 5*a* is a scrap section of the area indicated by the circle 5*a* in FIG. 5;

FIG. 6 is an enlarged top view of a leg foundation unit the lower half being in section on the line 6—6 in FIG. 7;

FIG. 7 is a section on the line 7—7 in FIG. 6;

FIG. 8 is a section on the line 8—8 in FIG. 6 the left hand half looking in the direction of arrow B and the right hand half looking in the direction of the arrow C;

FIG. 9 is a scrap view showing how a leg is attached to the central column;

FIG. 10 is an enlarged view corresponding to FIG. 9 partly in section; and FIG. 11 shows the seven stages in the erection of the structure.

Figure 1:
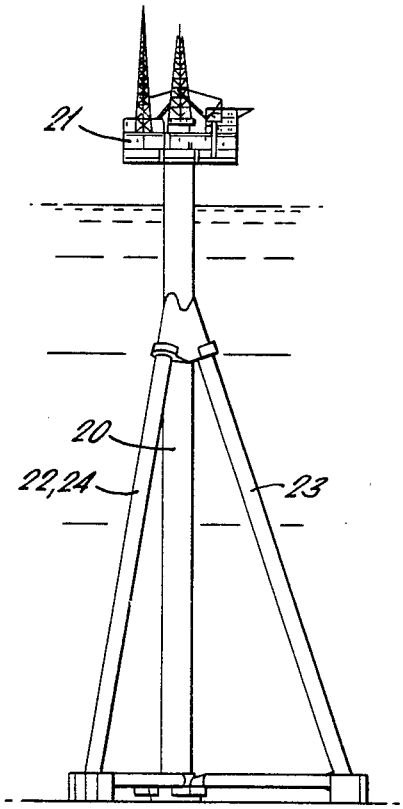
FIG. 1 is a front elevation of the structure.
Figure 2:
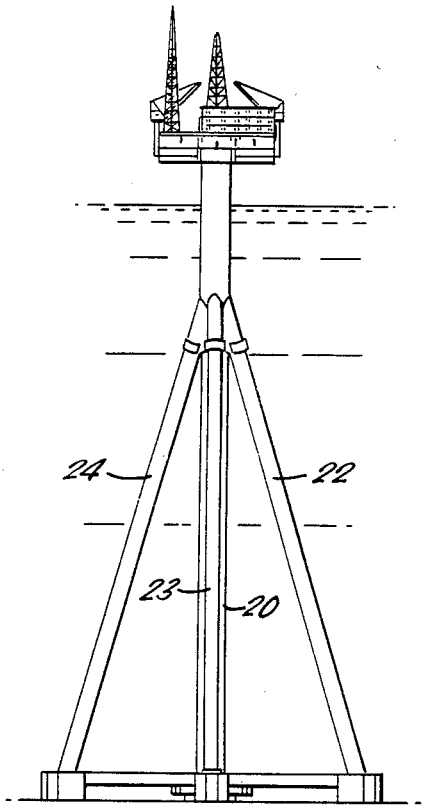
FIG. 2 is a side elevation of the structure.
Figure 3:
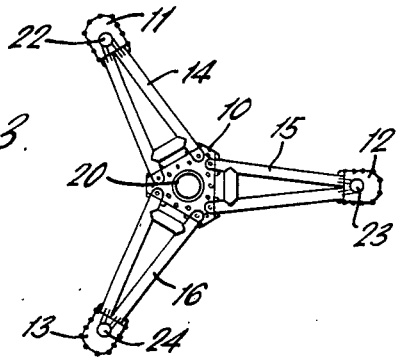
FIG. 3 is a plan view of the base frame.
Figure 4:
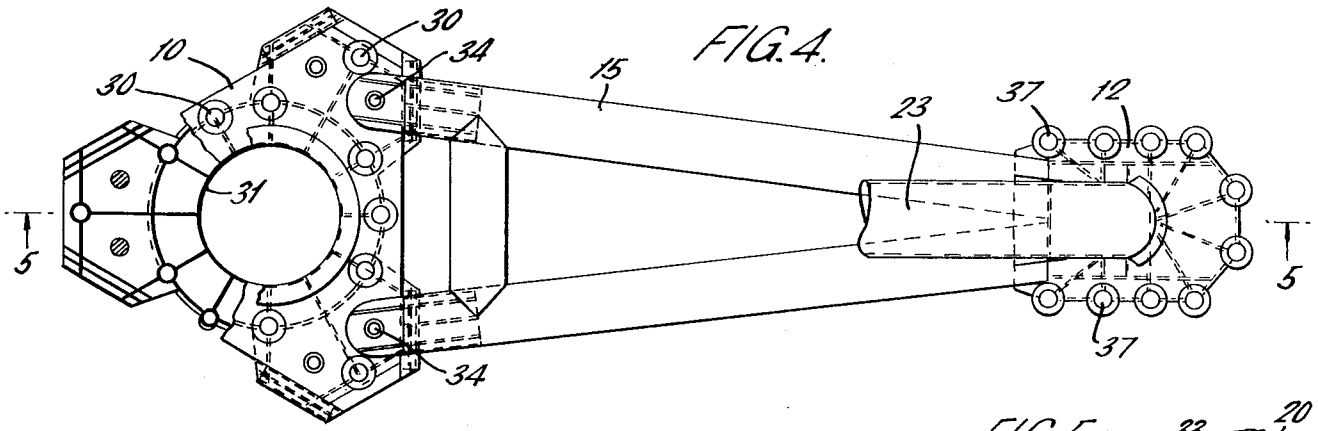
FIG. 4 is an enlarged plan view of part of the base frame.

The structure comprises, as can be seen from FIGS. 1 to 3, a base frame comprising a column foundation unit 10 and three leg foundation units 11, 12 and 13. The leg foundation units are located with regard to the column foundation unit by means of spacer framer 14, 15 and 16.

A central column 20 extends upwardly from the column foundation unit 10 and supports at its upper end a platform 21 provided with all the usual equipment. The column 20 is supported by means of three support legs 22, 23 and 24 which extend between the leg foundation units and the column. The column contains services such as conductors, risers and water injection pipes Referring now to FIGS. 4 to 8 the connection of the column and a leg 23 to the base frame will now be described although it will be understood that the legs 22 and 24 are attached to the base frame in exactly the same way as the leg 23.

The column foundation unit 10 is generally triangular in appearance as viewed from above and is attached to the sea bed by means of piles 30. In this example nine piles are arranged spaced equally from the centreline of the unit and three further piles are arranged at the three corners of the unit.

A central cylindrical recess 31 is provided and the column 20 is located in this recess. It will be appreciated from FIGS. 5 and 5*a* that the cylindrical recess 31 extends above the unit 10 and has a frusto-concial flange 32. The column 20 similarly has a frusto-conical flange 33 which is positioned against the flange 32 by grouting to finally locate the column with regard to the foundation unit and to carry centre column load if necessary.

The spacing member 15 is of a wishbone construction having the two separated ends of the wishbone located in locating pins 34 on the unit 10 which engage in suitable holes at the ends of the wishbone. The outer end of the member 15 is welded to the leg foundation unit 12 and forms an integral structure therewith. The unit 12 is also attached to the sea bed by piles 37 of which there are in this example ten arranged around the periphery of the unit.

The leg 23 is received in a recess 40 which is wedge-shaped as viewed in FIG. 7. This allows the leg 23 to be received into the recess when the leg is in a vertical position and for the leg to swing into the position shown in FIG. 7. Two locking lugs 41 are provided at the base of the leg and these lugs, which extend outwardly diametrically opposite each one another on the leg, engage in locking recesses 42 provided in the leg foundation unit so that the leg 23 cannot be removed from the foundation unit axially of the leg when the leg is in its inclined position.

The connection of the legs at their upper ends to the columns will now be described with reference to FIGS. 9 and 10 which show the attachment of the leg 23 to the column although it will be understood that this applies equally to the other legs.

It will be seen that the column is provided with an integral tetrahedron shaped nodal structure having three projection 45, each of which has a short tubular collar 54 of the same cross-section as the legs. Furthermore surrounding and as an integral part of this structure is a partial sleeve 46 which is hollow. A saddle 47 is provided at the part of the collar nearest the column.

The leg 23 when it is inclined to the vertical is positioned in the saddle as is shown in FIG. 9. The column can then be ballasted downwardly with regard to the legs until the legs engage the collar 54 as shown in FIG. 10. It will be seen that in this position the legs abut the collar 54 and are received within part of the projections 45.

The sleeves 46 are hollow and it is possible as indicated in FIG. 10 for workmen to operate from within the sleeves, and the nodal structure projections 45. First of all water is removed from the recesses in the sleeves and the projections 45 after inflatable packings 49 have been positioned between the nodal structure 45 and the legs. The legs can then be welded to the collars 54 from within the nodal structure 45 and from inside the legs. It will be appreciated that appropriate manholes are provided to enable people to enter the collars as at 50 and to enable people to enter within the legs via the nodal structure as at 51.

It will also be appreciated that the upper ends of the legs are closed off by bulkheads 52 and the upper end of the column is closed off by a bulkhead 53. Similarly the column may be divided throughout its length by appropriate bulkheads as may be the legs to enable flooding of the legs and column where appropriate.

The manner of erection of the structure will now be described with regard to FIG. 11.

First of all the column foundation unit 10 is placed in position as shown at Stage 1 and then the leg foundation members together with the spacers are attached to the column foundation unit as shown at Stage 2. The foundation units are of course piled into the sea bed.

The central column 20 is then floated to location horizontally and subsequently up-ended to the position shown in Stage 3. by appropriate ballasting of the column using the various compartments in the column. At this stage the column 20 is only just located inside the recess 20 in the column foundation unit.

The three support legs 22, 23 and 24 are then towed into position and up-ended in exactly the same way as the central column and are first located into their recesses in a vertical position and then tilted to engage the saddles on the column. The column in stages 3, 4 and 5 is supported by means of ropes which are indicated at 60 and these can either be attached to anchors on the sea bed or to appropriate vessels. The central column is then lowered as indicated in stage 6 so that the support legs 22, 23 and 24 are received in the nodal structure of the column and once the sleeves and the appropriate spaces within the support leg have been evacuated of water the legs are welded to the collars of the nodal structure of the column to form an integral unit. Finally the platform 21 is placed in position as shown at stage 7.

The structure just described is capable of use in water depths of the order of 150–450 meters and it will be appreciated that it is a great advantage for structures of this size to have the structure assembled in situ.

We claim:

1. An offshore tower comprising:

a base structure for positioning on the sea bed, said base structure including a central column foundation unit, the latter being formed with a vertically extending central recess, said base structure also having a plurality of horizontally extending leg foundation units each formed at points spaced horizontally from the central column unit with a plurality of upwardly facing wedge-shaped leg recesses;

a vertically disposed central enclosed tubular column containing services such as conductors and risers, the lower end of said column slideably extending into the central recess of the base structure to an initial depth when said column is first lowered thereinto, and said base structure extending to above the sea level to support a service platform;

at least three tubular support legs having their lower ends connected to said leg foundation units by insertion within said leg recesses when said legs are lowered vertically thereinto, the connection between said leg recesses and the lower end of said legs permitting said legs to be swung from a vertical position towards said column;

a nodal structure on said column having downwardly and outwardly extending projections formed with collars at their lower ends of larger diameter than the legs that slideably receive the upper end of each of said legs; and a saddle on each said collar disposed adjacent the column and formed with a downwardly and outwardly extending surface, with the upper end of said legs being swung from a generally vertically extending initial position inwardly towards said column and into their respective collars in abutment with the lower end of the nodal structure, as the column is lowered to a second depth lower than its initial depth and with the upper end of the legs being guided into their respective collars by engagement with the downwardly and outwardly extending surfaces of the saddles for attachment to the structures.

2. An offshore tower as set forth in claim 1 which further includes packing means disposed between the upper ends of said legs and said collars to define a water-tight enclosure surrounding the upper portion of said legs at the point of connection to the lower end of the nodal structures, from which enclosure water is removable whereby said legs can be welded to said nodal structures below the surface of the water in dry surroundings.

3. An offshore tower as recited in claim 1 wherein the surfaces of the leg recesses remote from the column extend vertically and inwardly towards the column at an angle generally corresponding to the angle of the downwardly and outwardly extending surfaces of the saddles.

4. An offshore tower as set forth in claim 1 wherein grout is introduced between the lower end of the column and the central recess of the base structure.

5. An offshore tower as set forth in claim 2 wherein the surfaces of the leg receses remote from the column extend vertically and inwardly towards the column at an angle generally corresponding to the angle of the downwardly extending surfaces of the saddles.

6. An offshore tower as set forth in claim 1 in which locking means are provided between the legs and the leg recesses which locking means engage when the legs are swung from the vertical to the inclined positions.

* * * * *